US007368417B2

(12) United States Patent
Gaudreault

(10) Patent No.: US 7,368,417 B2
(45) Date of Patent: May 6, 2008

(54) HARD SURFACE CLEANING COMPOSITIONS COMPRISING A LAURYL HYDROXYSULTAINE

(75) Inventor: Rosemary A. Gaudreault, Park Ridge, IL (US)

(73) Assignee: Jelmar LLC, Skokie, IL (US)

( * ) Notice: Subject to any disclaimer, the term of this patent is extended or adjusted under 35 U.S.C. 154(b) by 0 days.

(21) Appl. No.: 11/446,702

(22) Filed: Jun. 5, 2006

(65) Prior Publication Data

US 2006/0223735 A1 Oct. 5, 2006

Related U.S. Application Data

(62) Division of application No. 10/831,037, filed on Apr. 23, 2004, now Pat. No. 7,094,742.

(51) Int. Cl.
*C11D 1/92* (2006.01)
*C11D 3/44* (2006.01)
*C11D 7/26* (2006.01)

(52) U.S. Cl. ..... 510/238; 510/253; 510/362; 510/363; 510/424; 510/432; 510/434; 510/477; 510/506

(58) Field of Classification Search ..... 510/238, 510/253, 362, 363, 424, 432, 434, 477, 506
See application file for complete search history.

(56) References Cited

U.S. PATENT DOCUMENTS 3,993,575 A 11/1976 Howanitz et al.
4,294,764 A 10/1981 Rinehart
4,983,317 A 1/1991 Requejo et al.
5,122,568 A 6/1992 dePierne et al.
5,139,614 A 8/1992 dePierne et al.
5,362,422 A * 11/1994 Masters ..... 510/424
5,384,063 A * 1/1995 Woo et al. ..... 510/422
5,399,280 A * 3/1995 Woo et al. ..... 510/424
5,468,303 A 11/1995 Thomas, Sr.
5,785,962 A * 7/1998 Hinz et al. ..... 424/70.22
5,817,615 A 10/1998 Garabedian, Jr. et al.
5,925,606 A 7/1999 Stamm
5,962,388 A 10/1999 Sherry et al.
5,990,066 A 11/1999 Gordon et al.
5,998,358 A * 12/1999 Herdt et al. ..... 510/506
6,015,780 A 1/2000 Llosas Bigorra et al.
6,034,181 A 3/2000 Bazaj et al.
6,103,686 A 8/2000 Asakawa et al.
6,121,219 A 9/2000 Herdt et al.
6,156,129 A 12/2000 Hlivka et al.
6,277,805 B1 8/2001 Kupneski
6,281,182 B1 * 8/2001 Leonard et al. ..... 510/235
6,346,508 B1 2/2002 Leonard et al.
6,384,010 B1 5/2002 Wagers
6,399,563 B1 6/2002 Durbut et al.
6,423,674 B1 7/2002 Williams et al.
6,429,182 B1 8/2002 Julemont et al.
6,429,183 B1 * 8/2002 Leonard et al. ..... 510/438
6,432,395 B1 8/2002 Rochon et al.
6,436,892 B1 8/2002 Leonard et al.
6,479,453 B2 11/2002 Man
6,551,985 B1 4/2003 Bianchetti et al.
6,627,590 B1 9/2003 Sherry et al.
6,660,706 B1 12/2003 Koester et al.
6,699,825 B2 3/2004 Rees et al.
6,699,828 B1 * 3/2004 de Buzzaccarini et al. . 510/372
6,740,626 B2 * 5/2004 Neumiller ..... 510/109
6,821,939 B1 11/2004 Szewczyk et al.
7,094,742 B2 * 8/2006 Gaudreault ..... 510/253
2001/0023127 A1 9/2001 Andreas
2001/0034313 A1 10/2001 Honda et al.
2002/0187918 A1 12/2002 Urban
2003/0099570 A1 * 5/2003 Barnabas et al. ..... 422/28
2003/0100465 A1 5/2003 Kilkenny et al.
2003/0224958 A1 12/2003 Andreas
2004/0023834 A1 2/2004 Inoue et al.

OTHER PUBLICATIONS

Non-literature information: Commercially sold composition, sold under the name CLR, at least as early as Apr. 22, 2003, comprising: a diluent, an inorganic acid, a first organic acid, a second organic acid different from the first organic acid, a surfactant non consisting of a sultaine; a solvent and a colorant.

Non-literature information: Commercially sold composition, sold under the name CLR Kitchen and Bath Cleaner, at least as early as Apr. 22, 2003, comprising: a diluent, an organic acid, a surfactant not consisting of a sultaine, a solvent and a fragrance.

* cited by examiner

*Primary Examiner*—Charles Boyer
(74) *Attorney, Agent, or Firm*—Greenberg Traurig LLP

(57) ABSTRACT

A hard surface cleaning solution having improved cleaning and descaling properties. In one formulation, the cleaning solution comprises a first organic acid, a second organic acid, a surfactant, a solvent and a diluent. The first organic acid is a carboxylic acid preferably comprising lactic acid, while the second organic acid is a carboxylic acid preferably comprising gluconic acid. The surfactant is selected from the group consisting of sultaines, betaines and amino propionates. The solvent is a an alkoxylated alcohol preferably selected from the propylene glycol ether class of compounds. In a second formulation, the cleaning solution comprises a first organic acid, a surfactant, a solvent and a diluent. The first organic acid is a carboxylic acid preferably comprising lactic acid, while the surfactant is selected from the group consisting of sultaines, betaines and amino propionates and the solvent is a an alkoxylated alcohol preferably selected from the propylene glycol ether class of compounds. The cleaning solutions may also include other components such as colorants, fragrance enhancers, corrosion inhibitors, nonionic surfactants or other additives.

12 Claims, No Drawings

HARD SURFACE CLEANING COMPOSITIONS COMPRISING A LAURYL HYDROXYSULTAINE

This application is a continuation/division of, and claims priority of the filing date of, U.S. Ser. No. 10/831,037, filed Apr. 23, 2004, now U.S. Pat. No. 7,094,742.

BACKGROUND OF THE INVENTION

1. Field of the Invention

The present invention relates in general to an improved cleaner for hard surface cleaning applications, including kitchens, bathrooms, tubs and tiles, amongst others, and more particularly to a hard surface cleaning composition having improved cleaning and descaling properties.

2. Background Art

Hard surface cleaning compositions have been known and used in a variety of applications, including bathrooms, kitchens and other areas, particularly for toilets, showers, bathtubs, sinks, tiles, countertops, walls, floors and the like. Often times, hard surfaces accumulate both soap scum stains, which are typically residues of various types of soaps used in a household, as well as hard water stains, which are typically the result of the deposition of calcium, lime or various salts on hard surfaces over the course of time and use of various household surfaces.

Cleaning solutions for these household surfaces have been formulated to address both the removal of soap scum stains, as well as the descaling of hard water stains. In particular, many of these cleaning solutions have employed a combination of components, in a number of instances including strong inorganic acids, organic acids or a combination of both, a surfactant or wetting agent, a solvent and a diluent to address one or both of these types of stains and/or build-ups. The acid component is typically selected to address descaling of hard water stains, while the surfactant component is typically a detergent selected to attack soap scum. Further, other additives have also been used in combination with cleaning formulations to either enhance performance or make a particular formulation more desirable from a visual or odor perspective, such as PH adjusters, stabilizing agents, colorants and fragrances, amongst others.

For instance, Sherry et al., U.S. Pat. No. 6,627,590, discloses an acidic hard surface cleaning composition which includes (1) an alkyl sulfate surfactant containing 10 carbon atoms (comprising about 0.5 wt. % to about 5 wt. % of the solution), (2) one or more organic cleaning solvents (comprising about 1 wt. % to about 6 wt. % of the solution), (3) a mono or polycarboxylic acid (comprising about 3 wt. % to 5 wt. % of the solution) and (4) an aqueous solvent (comprising about 60-90 wt. % of the solution). Additionally, the acidic hard surface cleaner of Sherry et al. may also include a small amount of a anionic and/or nonionic detergent surfactant, preferably an anionic co-surfactant, examples of which include a sulfate or carboxylate hydrophilic head group. The $C_{10}$ alkyl sulfate preferably takes the form of an ammonium salt or a sodium salt. The organic cleaning solvent is based upon propylene glycol chemistry, preferably selected from the di- and tri-propylene glycol derivates of propyl and butyl alcohol. Citric acid is specified as being the most preferred carboxylic acid and is required by the claims; however, Sherry et al. also discloses the use of other mono or polycarboxylic acids, including acetic acid, glycolic acid, tartaric acid, succinic acid, glutaric acid, adipic acid and mixtures thereof. The cleaning solution has a pH of about 2-5.

Stamm, U.S. Pat. No. 5,925,606, discloses a concentrated acidic liquid detergent composition for cleaning soap scum, lime scale, etc. from hard surfaces. The liquid detergent comprises a carboxylic acid in an amount of 0.25-50 wt. % (preferably 1-25 wt. %), a surfactant in the amount of about 0.05-20 wt. % (preferably 0.1-15 wt. %) and an organic solvent present in the amount of approximately 0.25-20 wt. % (preferably 0.4-10 wt. %). The carboxylic acid is preferably a hydroxy monocarboxylic acid having up to four carbon atoms, with hydroacetic acid listed as being the only specific acid that is indicated as preferred, that is claimed or that is even disclosed. The surfactant is an anionic surfactant, a non-ionic surfactant or a mixture thereof, and may be chosen from alkyl sulfonates, alkyl ether sulfates (such as sodium lauryl sulfate), amongst many others. The organic solvent is preferably a $C_1$ to $C_6$ alkyl ether of either ethylene glycol or propylene glycol and derivates thereof, including propylene glycol monomethyl ether. The formula may also include other additives, such as pH adjustors, stabilizing agents, preservatives, fragrances and dyes.

Rochon et al., U.S. Pat. No. 6,432,395 discloses a cleaning composition containing naturally derived components. The cleaning composition includes three principal components, including an organic acid (comprising 0.004-28 wt. % of the composition), an anionic surfactant (comprising 0.0003-7 wt. % of the solution) and a non-ionic surfactant (comprising 0.0035-36 wt. %) surfactant. The organic acid is a $C_1$-$C_{20}$ non-fatty carboxylic, dicarboxylic or tricarboxylic acid, preferably lactic acid—although other less preferable naturally derived organic acids such as maleic acid, citric acid, maleic acid, succinic acid, gluconic acid and polyaspartic acid are also disclosed. The anionic surfactant is disclosed as preferably an alkyl glucoester, chosen to provide enhanced hard water surface tolerance, foam stability and improved mildness to the skin. The non-ionic surfactant is preferably an alkyl polyglucoside, although a sorbitan ester can also be used, to provide effective surface tension reduction and detergency. A protein may also be added to reduce skin irritancy, while a naturally derived organic solvent, such as ethanol or naturally derived organic esters, may also be added to the cleaning solution to aid salvation of particularly heavy greasy films or residues.

Urban, U.S. Pub. No. US 2002/0187918 A1, discloses a hard surface cleaning composition having an acidic pH, providing for removal of soap scum stains and having low levels or irritability to the user. The cleaning composition includes an acid sequestrant (comprising about 0.1 to 10 wt. % of the solution), a mixture of hydrophobic and hydrophilic solvents (comprising about 0.1-10 wt. % of the solution), an anionic surfactant (comprising about 0.001-1 wt. % of the solution) and one or more optional components (comprising 0-20 wt. % of the solution). The acid is a combination of citric acid together with another acid effective in the removal of hard water stains, such as sulfonic acid, phosphoric acid, salicylic acid, sorbic acid, sulfamic acid, acetic acid, benzoic acid, boric acid, caproic acid, folic acid, oxilic acid, phosphorous acid, sulfonic acid, maleic acid, adipic acid, lactic acid, gluconic acid and glycolic acid, amongst others. A combination of citric acid and glycolic acid is most preferred. The solvent is a mixture of hydrophobic and hydrophilic solvents which solubilize soap scum and facilitate removal of stains from hard surfaces. The hydrophilic portion of the solvent comprises about 51 to 99% of the total weight of the solvent, and may comprise propylene glycol phenyl ether, ethylene glycol ether, propylene glycol n-butyl ether or other glycol-based ethers, while the hydrophilic portion of the solvent may include alcohols, glycols, acetates, propylene glycols and ethylene glycol n-butyl ethers, amongst others. The anionic surfactant is preferably selected from alkylphenoxybenzene disulfonates, linear alkylphenoxybenzene sulfonates and alkylnaphthalene sulfonates and salts thereof. The optional components can include non-ionic surfactants, forming agents, fragrances, colorants, pH adjusting agents and preservatives, amongst others.

Similarly, Rees et al, U.S. Pat. No. 6,699,825, discloses an acidic hard surface anti-microbial cleaner containing (1) about 0.2 wt. % of an organocarboxylic acid, about 2 wt. % of a volatile solvent selected from a group consisting of n-butyl, benzyl alcohol, phenylethanol and glycol ether solvents. The cleaning composition may also contain 0.1 wt. % of an anionic sulfated or sulfonated surfactants and about 5 wt. % of a co-solvent comprising water soluble monoprotic aliphatic alcohols and glycol ethers.

While these and other prior art hard surface cleaning formulations have been used effectively for cleaning a variety of hard surfaces, it is still desirable to find an improved cleaning solution which addresses both soap scum and the descaling of hard water stains, as well as one which is milder on the skin and has less odor.

It is also desirable to provide a cleaning solution which minimizes and/or eliminates the more corrosive inorganic acids, as well as the more corrosive organic acids, and instead uses less corrosive, but equally effective organic acids to achieve the desired cleaning results.

It is yet further desirable to find a cleaning solution with a specific combination of organic acids, surfactants and solvents which act in a synergistic manner to improve cleaning performance on hard surfaces. These and other objectives of the invention are described herein.

SUMMARY OF THE INVENTION

The present invention is directed to a hard surface cleaning solution. In a first embodiment, the hard surface cleaning solution comprises a first organic acid, a second organic acid, a surfactant, a solvent and a diluent. The first organic acid comprises a carboxylic acid preferably selected from the group consisting of lactic acid, glycolic acid, formic acid, citric acid and acetic acid. Most preferably, the first organic acid comprises lactic acid. The first organic acid comprises about 12 wt. % to about 18 wt. % of the active cleaning composition, and more preferably about 16 wt. % of the active cleaning solution.

The second organic acid comprises a carboxylic acid different from the first organic acid, and is preferably selected from the group consisting of gluconic acid, glycolic acid, formic acid, citric acid and acetic acid. Most preferably, the second organic acid comprises gluconic acid. The second organic acid comprises about 2.5 wt. % to about 3.75 wt. % of the active cleaning composition, and more preferably about 3.25 wt. % of the active cleaning solution.

The surfactant is preferably a zwitter ionic or amphoteric surfactant selected from the group consisting of sultaines, betaines and amino propionates. In a preferred embodiment, the surfactant comprises a sultaine, and more preferably a sulfonate of a fatty quaternary. Most preferably, the surfactant comprises a lauryl hydroxysultaine. The surfactant comprises about 1.5 wt. % to about 3.25 wt. % of the active cleaning composition, and more preferably about 2.04 wt. % of the active cleaning composition.

The solvent is preferably selected from the group consisting of alcohol ethers. More particularly, the solvent comprises a propylene glycol ether. Most preferably, the solvent comprises propylene glycol (mono) butyl ether. The solvent comprises about 0.5 wt. % to about 3.0 wt. % of the active cleaning composition, and more preferably about 1.4 wt. % of the active cleaning composition.

In a preferred embodiment, the diluent comprises deionized water. The diluent is preferably present in an amount of about 72 wt. % to about 84 wt. % of the active cleaning solution.

Also in a preferred embodiment, the hard surface cleaning solution has a pH of from about 1.2 to about 1.65. More preferably, the hard surface cleaning solution has a pH of from about 1.3 to about 1.5.

In another preferred embodiment, the hard surface cleaning solution may further include an additive selected from the group consisting of colorants, fragrance enhancers, non-ionic surfactants, corrosion inhibiting agents, defoamers, pH stabilizers and stabilizing agents. A colorant is particularly preferred in one embodiment of the present invention.

In a second embodiment, the hard surface cleaning solution comprises an organic acid, a surfactant, a solvent and a diluent. The organic acid comprises a carboxylic acid preferably selected from the group consisting of lactic acid, glycolic acid, formic acid, citric acid and acetic acid. Most preferably, the organic acid comprises lactic acid. The organic acid is present in an amount of about 8.0 wt. % to about 11.0 wt. % of the active cleaning composition, and more preferably in an amount of about 9.24 wt. % of the active cleaning composition.

The surfactant is preferably selected from the group consisting of sultaines, betaines and amino propionates. In a preferred embodiment, the surfactant comprises a sultaine, and more preferably a sulfonate of a fatty quaternary. Most preferably, the surfactant comprises a lauryl hydroxysultaine. The surfactant comprises about 2.25 wt. % to about 5.0 wt. % of the active cleaning composition, and more preferably about 3.0 wt. % of the active cleaning composition.

The solvent is preferably selected from the group consisting of alcohol ethers. More particularly, the solvent comprises a propylene glycol ether. Most preferably, the solvent comprises propylene glycol (mono) butyl ether. The solvent comprises about 0.5 wt. % to about 3.0 wt. % of the active cleaning composition, and more preferably about 1.4 wt. % of the active cleaning composition.

In a preferred embodiment, the diluent comprises deionized water. The diluent is preferably present in an amount of about 80.85 wt. % to about 89.18 wt. % of the active cleaning solution.

Also in a preferred embodiment, the hard surface cleaning solution has a pH of from about 1.3 to about 1.75. More preferably, the hard surface cleaning solution has a pH of from about 1.4 to about 1.6.

In another preferred embodiment, the hard surface cleaning solution may further include an additive selected from the group consisting of colorants, fragrance enhancers, non-ionic surfactants, corrosion inhibiting agents, defoamers, pH stabilizers and stabilizing agents. A fragrance enhancer is particularly preferred in one embodiment of the present invention.

DETAILED DESCRIPTION OF THE INVENTION

While this invention is susceptible of embodiment in many different forms, there are described several specific embodiments with the understanding that the present disclosure is to be considered as an exemplification of the principals of the invention and is not intended to limit the invention to the embodiments so described.

The present invention is directed to a liquid cleaning solution which is particularly suited for removing soap scum, hard water stains, lime scale and the like from various hard surfaces such as tubs, tiles, showers, sinks and other areas which are exposed to water and soap. The invention includes different embodiments, including a cleaning solution which is a more vigorous solution more suitable for removing hard water stains, lime scale and rust, as well as another cleaning solution which is more suitable as an every day cleaner for removing soap scum, hard water spots and associated calcium deposits as well as lime scale.

In a first embodiment, the cleaning solution includes a first chelating agent, a second chelating agent, a surfactant or wetting agent, a solvent and a diluent. The first and second chelating agents are both organic acids, particularly first and second organic acids, and are preferably selected from the class of carboxylic acids. Organic acids tend to be less corrosive, more environmentally friendly and break down more rapidly than counterpart inorganic acids which are often used in cleaning solutions. The first organic acid is preferably present in an amount of about 12.0 wt. % to about 18.0 wt. %, where the percentage is based upon the active component in the overall cleaning solution composition, which convention will be used throughout this specification unless indicated otherwise. The first organic acid is preferably selected from the group of carboxylic acids including lactic acid, glycolic acid, formic acid, citric acid and/or acetic acid. Most preferably, the first organic acid comprises lactic acid in an amount of 16.2 wt. % of the solution, which is sold under the Purac 88 brand and can be purchased from Purac America, headquartered in Lincolnshire, Ill.

The second organic acid, preferably present in an amount of approximately 2.5 wt. % to about 3.75 wt. % active in the formula, is also preferably a carboxylic acid such as gluconic acid, glycolic acid, formic acid, citric acid and/or acetic acid. Most preferably, the second organic acid is a polyhydroxycarboxylic acid, more preferably gluconic acid purchased under the trade name "Gluconal GA-50" from Purac America out of Lincolnshire, Ill. Of course, one of ordinary skill in the art with the present disclosure before them will readily appreciate that other carboxylic acids may also be used within the scope of the present invention.

The most preferred combination of first and second organic acids, namely lactic acid and gluconic acid, tends to be less corrosive than other combinations of organic and/or inorganic acids typically present in commercial hard surface cleaning solutions, which often include citric acid. Further, the gluconic acid is milder on the skin than many alternative acid cleaning components. Additionally, lactic acid and gluconic acid tend to have a more favorable odor than other substitute acids such as formic acid and better cleaning and descaling properties than alternative acids such as glycolic acid. Of course, the most preferred lactic and gluconic acids are also chosen as they have been found to have a synergistic compatibility with each other as well as with the surfactant system and solvent of the present invention. It is important that the organic acids are not reactive with and adverse to the surfactant system, which can cause a drop-off in effectiveness and functionality of the cleaning solution.

The surfactant is preferably an amphoteric surfactant, and is preferably a sultaine present in the cleaning solution in an amount of about 1.5-3.25 wt. %. Preferably, the surfactant is a sulfanate of a fatty quaternary, more preferably a hydroxysultaine, and most preferably a lauryl hydroxysultaine present in about 2.04 wt. % of the active formula. Lauryl hydroxysultaine can be purchased under the trade name Mackam LHS from McIntyre located in University Park, Ill. Sultaines exhibit excellent cleaning performance, as they do not foam as much when used in the cleaning solutions of the present invention. Additionally, sultaines exhibit a synergy with the organic acids described above to achieve the superior cleaning and descaling properties of the present cleaning solution. Other sultaines which may be used in the cleaning solution of the present invention, either alone or in combination with lauryl hydroxysultaine, include lauramidopropyl hydroxysultaine, cocamidopropyl hydroxysultaine, oleamidopropyl hydroxysultaine and tallowamidopropyl hydroxysultaine.

The surfactant may also be chosen from a class of betaines, including, without limitation, lauryl betaine, cetyl betaine, coco betaine and lauramidopropyl betaine. Additionally, the surfactant may also be selected from the amino propionate class of amphoteric surfactants, including, for example, sodium lauriminodipropionate. Of course, one of ordinary skill in the art with the present disclosure before them will readily recognize that other surfactants from the betaine and amino propionate classes, as well as other sultaines or combinations of the above classes of surfactants, may likewise be used in the present cleaning solution for effective performance. Additionally, other anionic and nonionic surfactants may also be used in combination with the other ingredients of the present cleaning solution to impart additional properties and/or benefits as would be known by one of ordinary skill in the art with the present disclosure before them.

The solvent is an ether alcohol based solvent, and preferably an alkoxylated glycol. More preferably, the solvent is selected from a group of propylene glycol ethers, such as dipropylene glycol methyl ether, tripropylene glycol methyl ether, dipropylene glycol normal butyl ether and propylene glycol normal butyl ether. Most preferred is a propylene glycol (mono) butyl ether sold under the trade name Arcosolv PnB manufactured by Lyondell, headquartered in Houston, Tex. The solvent is preferably present in the cleaning solution in the range of about 0.50 wt. % to about 3.0 wt. % of the active formula, and most preferably in an amount of about 1.4 wt. % of the active formula. Other solvents may be chosen from glycols based on the ether of preferably the propylene type. Likewise, ethylene type glycol ethers are contemplated for use with the present invention.

The diluent is preferably deionized water, which is present in a range of about 72.0 wt. % to about 83.5 wt. % active in the cleaning solution formula. More preferably, the diluent comprises about 77.15 wt. % of the active cleaning formulation.

Other components may also be added to the cleaning solution of the present invention to add a variety of properties or characteristics, as desired. For instance, additives may include colorants, fragrance enhancers, anionic or nonionic surfactants, corrosion inhibitors, defoamers, pH stabilizers, stabilizing agents, or other additives that would be known by one of ordinary skill in the art with the present disclosure before them. For instance, a colorant is preferred for use with the present cleaning solution, which colorant takes the form of a green LX-9405 purchased as Pylam Pylaklor Acid Green, which can be purchased Pylam Products Company, Inc. out of Tempe, Ariz. Such colorant is preferably used in a quantity sufficient to provide the desired color, preferably in the amount of approximately 0.00156 wt. % of the active formula.

Nonionic surfactants may also be added to the cleaning solution formula to enhance performance, which nonionic surfactants may be selected from secondary alcohol ethoxylates, branched secondary alcohol ethoxylates, alkyl polyglucosides, octylphenol ethoxylates and alcohol alkoxylates. These nonionic surfactants can be used to enhance the wetting agent properties of the solution.

Corrosion inhibitors may also be incorporated into the cleaning solution. The preferred class of corrosion inhibitors are imidazolines such as tall oil hydroxyethyl imidazoline, capryl hydroxyethyl imidazoline, cocoyl hydroxyethyl imidazoline, lauryl hydroxyethyl imidazoline and oleyl hydroxyethyl imidazoline. Of course, other corrosion inhibitors may also be used, as would be known by one of ordinary skill in the art with the present disclosure before them. Other additives such as the above described corrosion inhibitors or nonionic surfactants are added in quantities sufficient to impart the desired properties to the cleaning solution, as would be known by those of ordinary skill in the art with the present disclosure before them.

The cleaning solution according to the first embodiment of the present invention described immediately above preferably has a pH in the range of about 1.2 to about 1.65, and more preferably in the range of about 1.3 to about 1.5. If the pH is significantly higher than the desired ranges, the cleaning solution tends to exhibit decreased descaling abilities, while a pH significantly below the desired range tends to lead to a cleaning solution which is overly irritating to the skin and very corrosive.

In a second embodiment, the cleaning solution comprises a first chelating agent, a surfactant, a solvent and a diluent. A second chelating agent is not necessary in the second embodiment cleaning solution, as the second embodiment cleaning solution is directed to a daily cleaner for sinks, tiles and tubs, rather than a more acidic, stronger cleaner for removal of tougher calcium, lime and rust stains.

In the second embodiment of the cleaning solution of the present invention, the first chelating agent is an organic acid, and preferably a carboxylic acid present in an amount of about 8.0 wt. % to about 11.0 wt. % of the active formula. More preferably, the first organic acid comprises lactic acid in an amount of 9.24 wt. % of the solution, which is sold under the Purac 88 brand and can be purchased from Purac America, headquartered in Lincolnshire, Ill. Other carboxylic acids which are contemplated for use with the cleaning solution of the present invention include lactic acid, glycolic acid, formic acid, citric acid and acetic acid. Of course, one of ordinary skill in the art with the present disclosure before them will readily appreciate that other carboxylic acids may also be used within the scope of the present invention.

Like the surfactant described above for use in combination with the first embodiment of the cleaning solution, the surfactant is preferably an amphoteric surfactant. The surfactant is preferably a sultaine present in the cleaning solution in an amount of about 2.25 wt. % to about 5.0 wt. %. Preferably, the surfactant is a sulfanate of a fatty quaternary, more preferably a hydroxysultaine, and most preferably a lauryl hydroxysultaine present in about 3.0 wt. % of the active formula. Lauryl hydroxysultaine can be purchased under the trade name Mackam LHS from McIntyre located in University Park, Ill. Sultaines exhibit excellent cleaning performance, as they do not foam as much when used in the cleaning solutions of the present invention. Additionally, sultaines exhibit a synergy with the organic acids described above to achieve the superior cleaning and descaling properties of the present cleaning solution. Other sultaines which may be used in the cleaning solution of the present invention, either alone or in combination with lauramidopropyl hydroxysultaine, include hydroxysultaine, cocamidopropyl hydroxysultaine, oleamidopropyl hydroxysultaine and tallowamidopropyl hydroxysultaine.

The surfactant may also be chosen from a class of betaines, including, without limitation, lauryl betaine, cetyl betaine, coco betaine and lauramidopropyl betaine. Additionally, the surfactant may also be selected from the amino propionate class of amphoteric surfactants, including, for example, sodium lauriminodipropionate. Of course, one of ordinary skill in the art with the present disclosure before them will readily recognize that other surfactants from the betaine and amino propionate classes, as well as other sultaines or combinations of the above classes of surfactants, may likewise be used in the present cleaning solution for effective performance. Additionally, other anionic and nonionic surfactants may also be used in combination with the other ingredients of the present cleaning solution to impart additional properties and/or benefits as would be known by one of ordinary skill in the art with the present disclosure before them.

Also like the solvent described above for use in the first embodiment of the cleaning solution of the present invention, the solvent is an ether alcohol based solvent, and preferably and alkoxylated glycol. More preferably, the solvent is selected from a group of propylene glycol ethers, such as dipropylene glycol methyl ether, tripropylene glycol methyl ether, dipropylene glycol normal butyl ether and propylene glycol normal butyl ether. Most preferred is a propylene glycol (mono) butyl ether sold under the trade name Arcosolv PnB manufactured by Lyondell, headquartered in Houston, Tex. The solvent is preferably present in the cleaning solution in the range of about 0.50 wt. % to about 3.0 wt. % of the active formula, and most preferably in an amount of about 1.4 wt. % of the active formula. Other solvents may be chosen from glycols based on the ether of preferably the propylene type. Likewise, ethylene type glycol ethers are contemplated for use with the present invention.

The diluent is preferably deionized water, which is present in a range of about 80.85 wt. % to about 89.18 wt. % active in the cleaning solution formula. More preferably, the diluent comprises about 86.25 wt. % of the active cleaning formulation.

Further, the cleaning solution according to the second embodiment of the present invention also preferably includes a fragrance enhancing component, which may comprise any one of a wide variety of known fragrance additives, to impart a desired fragrance to the cleaning solution. One preferred example is Lavender Fragrance No. 269-749 purchased from Alpine Aeromatics in Piscataway, N.J. This provides the cleaning solution with a pleasant, fragrant odor, which can overcome the less desirable odors of the acid and/or other components of the formulation. The fragrance is preferably added in an amount of approximately 0.07 wt. % to about 0.15 wt. %.

Additionally, other additives may also be included with the above cleaning solution formulation as well, such as those described above in reference to the first embodiment of the cleaning solution having two chelating agents, which can be used in combination with either of the first or second cleaning solution embodiments described above.

The cleaning solution according to the second embodiment of the present invention is less acidic than the cleaning solution according to the first embodiment of the present invention. In particular, the cleaning solution according to the second embodiment of the present invention preferably has a pH in the range of about 1.3 to about 1.75, and more preferably in the range of about 1.4 to about 1.6. Again, extending the pH significantly higher or significantly lower can lead to undesirable losses in descaling abilities, as well as increases in corrosiveness and skin irritability.

The cleaning solutions according to the present invention are typically bottled in plastic containers, and used by spraying or wiping the cleaning composition onto the surface of a tub, tile, sub or shower to be cleaned.

The following examples are given to illustrate the cleaning compositions of the present invention, but are not intended to limit the invention to the examples included herewith. The following examples below illustrate exemplary formulations and preferred formulations of the cleaning composition according to the present invention. It is to be understood that the examples are presented by means of illustration only and that further use of formulations that fall within the scope of the present invention and the claims herewith may be readily produced by one skilled in the art with the present disclosure before them.

PREPARATION OF EXAMPLE CLEANING SOLUTION FORMULATIONS

Example formulations illustrating certain preferred embodiments of the inventive cleaning compositions of the present invention are described in detail in Tables I and II below and were formulated generally in accordance with the following protocol.

EXAMPLE 1

Cleaning Solution Formulation 1

A cleaning solution according to the first embodiment of the present invention was prepared by first charging 8266.6 grams of deionized water into a tank equipped with a mixer. Lactic acid, in the form of Purac 88, was then added in an amount of 2203.2 grams to the deionized water in the tank. Next, 780.0 grams of gluconic acid, in the form of Gluconal GA-50, were added into the tank. After addition of the gluconic acid, 582.0 grams of lauryl hydroxysultaine, in the form of Mackam LHS, were added to the tank from below the surface of the liquid in the tank to minimize foaming. In production, it is preferred to pump the lauryl hydroxysultaine surfactant in through the bottom of a stainless steel tank. After the contents of the tank were mixed thoroughly, the propylene glycol (mono) butyl ether solvent was added into the stainless steel tank in the form of Arcosolv PnB in an amount of 168.0 grams. Finally, 0.19 grams of Pylam Pylaklor Acid Green LX-9405 colorant were added to the mixture to achieve the desired color.

The above preparation of Cleaning Solution Formulation 1 resulted in the particular cleaning composition shown in Table 1. Inasmuch as various ones of the raw material components of the cleaning solution are purchased in a form that is at least partially diluted with water, Table 1 provides the percentage of each component which is active in the raw material, the percentage of each particular component (active material and any water in the raw material solution) in the formula and the percentage of each component in the active portion of the formula.

TABLE 1

Cleaning Solution Formulation 1

| Ingredient Name | % Active in Raw Material | % in Formula | % Active in Formula |
|---|---|---|---|
| Deionized Water | | 68.88844 | 77.15 |
| Purac 88 Lactic Acid | 88 | 18.36000 | 16.16 |
| Gluconal GA-50 Gluconic Acid | 50 | 6.50000 | 3.25 |
| Mackam LHS Lauryl Hydroxysultaine | 42 | 4.85000 | 2.04 |
| Arcosolv PnB Propylene Glycol (Mono) Butyl Ether | 100 | 1.40000 | 1.40 |
| Pylam Pylaklor Acid Green LX-9405 | 100 | 0.00156 | 0.00156 |

EXAMPLE 2

Cleaning Solution Formulation 2

A cleaning solution according to the second embodiment of the present invention was prepared by first charging 9700.8 grams of deionized water into a stainless steel tank equipped with a mixer. Lactic acid, in the form of Purac 88, was then added in an amount of 1260 grams to the deionized water in the stainless steel tank. Next, 858 grams of lauryl hydroxysultaine, in the form of Mackam LHS, were added to the stainless steel tank from below the surface of the liquid in the tank to minimize foaming. Like with preparation of Cleaning Formulation 1 described above, it is preferred to pump the lauryl hydroxysultaine surfactant in through the bottom of the tank. After the contents of the tank were mixed thoroughly, the propylene glycol (mono) butyl ether solvent was added into the stainless steel tank in the form of Arcosolv PnB in an amount of 168 grams. Finally, 13.2 grams of Lavender #269-749 fragrance enhancer were added to the mixture to achieve the desired odor, and the mixture was mixed until it was homogeneous.

The above preparation of Cleaning Formulation 2 resulted in a cleaning solution having the breakdown of ingredients listed below in Table 2. Like Table 1, Table 2 also provides the percentage of each component which is active in the raw material, the percentage of each particular component (active material and any water in the raw material solution) in the formula and the percentage of each component in the active portion of the formula. Notably, the sequence of addition of the components of the cleaning formulations is important, as a hazy product may result if the sequence is broken.

TABLE 2

Cleaning Solution Formulation 2

| Ingredient Name | % Active in Raw Material | % in Formula | % Active in Formula |
|---|---|---|---|
| Deionized Water | | 80.84000 | 86.25 |
| Purac 88 Lactic Acid | 88 | 10.50000 | 9.24 |
| Mackam LHS Lauryl Hydroxysultaine | 42 | 7.15000 | 3.00 |
| Arcosolv PnB Propylene Glycol (Mono) Butyl Ether | 100 | 1.40000 | 1.40 |
| Lavender Fragrance #269–749 | 100 | 0.11000 | 0.11000 |

TESTING OF EXAMPLE CLEANING SOLUTION FORMULATIONS

The hard surface cleaning solutions of the present invention were evaluated for scum removal efficacy, as well as for descaling efficacy. Cleaning Formulations 1 and 2 were each subjected to testing by two independent laboratories to measure each formulation's ability to remove soap scum and to remove hard water scale.

EXAMPLE 3

In a first set of tests, Cleaning Solution Formulation 1, prepared in accordance with Example 1 and with a composition detailed in Table 1 above and in accordance with the first embodiment of the present invention, was subjected to a standard ASTM D5343 Scum Removal Test by two independent laboratories, Lab 1 and Lab 2. Cleaning Solution Formulation 1 was compared against a leading commercial calcium, lime and rust hard surface cleaning solution sold by Jelmar Corporation of Skokie, Ill. under the brand name CLR.

The standard ASTM D5343 Scum Removal Test is a visual test based upon a cleaner's ability to remove soap scum from plate tiles. Generally, tiles are plated with material which causes the formation of soap scum and baked. The tiles are then wiped pursuant to standard procedures with each of Jelmar's CLR commercial formulation and Cleaning Solution 1 which is the subject of the present invention. The ability of each cleaner to remove soap scum is then graded visually by a panel of trained experts on a scale of 1 to 5, with 1 designated little or no removal and 5 designating virtually complete removal.

The results of the ASTM D5343 Scum Removal Test for Cleaning Solution 1 are shown below in Table 3.

TABLE 3

| ASTM D5343 Scum Removal Test Cleaning Solution 1 | | |
|---|---|---|
| | Lab 1 | Lab 2 |
| Commercial CLR Cleaner | 15.9% | 48.8% |
| Cleaning Solution 1 | 19.2% | 74.0% |

EXAMPLE 4

In a second set of related tests, Cleaning Solution Formulation 2, prepared in accordance with Example 2 and with a composition detailed in Table 2 above and in accordance with the second embodiment of the present invention, was subjected to the same standard ASTM D5343 Scum Removal Test by both independent laboratories, Lab 1 and Lab 2. Cleaning Solution Formulation 2 was compared against a leading commercial bath and kitchen hard surface cleaning solution sold by Jelmar Corporation of Skokie, Ill. under the brand name CLR Bath and Kitchen.

The results of the soap scum removal testing for Cleaning Solution 2 are shown below in Table 4.

TABLE 4

| ASTM D5343 Scum Removal Test Cleaning Solution 2 | | |
|---|---|---|
| | Lab 1 | Lab 2 |
| Commercial CLR Bath and Kitchen Cleaner | 42.4% | 16.3% |
| Cleaning Solution 2 | 63.4% | 80.1% |

EXAMPLE 5

In a third set of tests, Cleaning Solution Formulation 1, prepared in accordance with Example 1 and with a composition detailed in Table 1 above and in accordance with the first embodiment of the present invention, was subjected to a standard Purac 1998-10-04 Descaling Test by both independent laboratories, Lab 1 and Lab 2. Cleaning Solution Formulation 1 was again compared against Jelmar's commercial CLR cleaning formulation.

The Purac 1998-10-04 Descaling Test is a weight-based test which measures the amount of calcium carbonate a cleaner removes from a hard surface. Generally, cubes of marble are scaled with calcium carbonate and weighed. The cube is placed into a solution of the cleaning formulations being tested for a set time interval. The cube is then removed from the cleaner, allowed to dry and then weighed. Any weight loss indicates removal of calcium carbonate from the marble cubes, and thus descaling capability, measured in a percentage.

The results of the descaling testing on Cleaning Solution 1 are show below in Table 5. The descaling percentages reported by Lab 1 for Cleaning Solution 1 are computed as the average performance of 1 cube at each of 5, 10 and 30 minutes, while the descaling percentages reported by Lab 2 for Cleaning Solution 1 are computed as the average performance of 2 cubes at each of 5, 10 and 30 minutes.

TABLE 5

| Purac 1998-10-04 Descaling Test Cleaning Solution 1 | | |
|---|---|---|
| | Lab 1 | Lab 2 |
| Commercial CLR Cleaner | 2.9% | 2.06% |
| Cleaning Solution 1 | 4.9% | 4.08% |

EXAMPLE 6

In a fourth set of related tests, Cleaning Solution Formulation 2, prepared in accordance with Example 2 and with a composition detailed in Table 2 above and in accordance with the second embodiment of the present invention, was subjected to the same standard Purac 1988-10-04 Descaling Test by both independent laboratories, Lab 1 and lab 2. Cleaning Solution Formulation 2 was again compared against a leading commercial bath and kitchen hard surface cleaning solution sold by Jelmar Corporation under the brand name CLR Bath and Kitchen.

The results of the descaling testing on Cleaning Solution 2 are show below in Table 6. The descaling percentages reported by Lab 1 for Cleaning Solution 1 are computed as the average performance of 2 cubes at each of 5, 10 and 30 minutes, while the descaling percentages reported by Lab 2 for Cleaning Solution 2 are likewise computed as the average performance of 2 cubes at each of 5, 10 and 30 minutes.

TABLE 6

| Purac 1998-10-04 Descaling Test Cleaning Solution 2 | | |
|---|---|---|
| | Lab 1 | Lab 2 |
| Commercial CLR Cleaner | 1.53% | 0.89% |
| Cleaning Solution 2 | 4.17% | 2.18% |

The above test results by independent laboratories demonstrate that the cleaning solutions that are the subject of the present invention exhibit improved soap scum and scale removal properties over leading commercial hard surface cleaning formulations. Both Cleaning Solution Formula 1 and Cleaning Solution Formula 2 performed significantly better at removing soap scum stains in the standard ASTM D5343 Scum Removal Test than one of the leading commercial calcium, lime and rust hard surface cleaner. Likewise, both Cleaning Solution 1 and Cleaning Solution 2 exhibited significantly increased calcium carbonate removal during the Purac 1988-10-04 Descaling Test than one of the leading commercial bathroom and kitchen cleaners, indicating improved performance in addressing hard water stains.

The invention claimed is:

1. A hard surface cleaning solution comprising:

an organic acid comprising a carboxylic acid selected from the group consisting of lactic acid, formic acid, citric acid and acetic acid, in an amount of about 8.0 wt. % to about 11.0 wt. % of the active cleaning composition;

a surfactant, in an amount of about 2.25 wt. % to about 5.0 wt. % of the active cleaning composition;

a solvent selected from the group consisting of alcohol ethers, in an amount of about 0.5 wt. % to about 3.0 wt. % of the active cleaning composition; and a diluent;

wherein the surfactant comprises a lauryl hydroxysultaine.

2. The hard surface cleaning solution of claim 1 wherein the organic acid comprises lactic acid.

3. The hard surface cleaning solution of claim 2 wherein the lactic acid comprises about 9.24 wt. % of the active cleaning composition.

4. The hard surface cleaning solution of claim 1 wherein the surfactant comprises about 3.0 wt. % of the active cleaning composition.

5. The hard surface cleaning solution of claim 1 wherein the solvent comprises a propylene glycol ether.

6. The hard surface cleaning solution of claim 5 wherein the solvent comprises propylene glycol (mono) butyl ether.

7. The hard surface cleaning solution of claim 6 wherein the solvent comprises about 1.4 wt. % of the active cleaning composition.

8. The hard surface cleaning solution of claim 1 wherein the diluent comprises about 80.85 wt. % to about 89.18 wt. % of the active cleaning composition.

9. The hard surface cleaning composition of claim 1 wherein the composition has a pH of from about 1.3 to about 1.75.

10. The hard surface cleaning composition of claim 9 wherein the composition has a pH of from about 1.4 to about 1.6.

11. The hard surface cleaning composition of claim 1 further including an additive selected from the group consisting of colorants, fragrance enhancers, nonionic surfactants, corrosion inhibiting agents, defoamers, pH stabilizers and stabilizing agents.

12. The hard surface cleaning composition of claim 11 wherein the additive comprises a fragrance enhancer.

* * * * *